United States Patent [19]

Braun

[11] Patent Number: 4,742,928

[45] Date of Patent: May 10, 1988

[54] DISPENSING CLOSURE WITH ARTICULATED FLIP-TOP CAP

[75] Inventor: Morris Braun, Chicago, Ill.

[73] Assignee: W. Braun Company, Chicago, Ill.

[21] Appl. No.: 61,905

[22] Filed: Jun. 11, 1987

[51] Int. Cl.[4] ..... B65D 47/06

[52] U.S. Cl. ..... 215/235; 220/335; 220/338; 222/556; 222/534

[58] Field of Search ..... 215/235, 338, 237; 220/335, 338, 337; 222/517, 556, 534, 536, 533, 545, 546

[56] References Cited

U.S. PATENT DOCUMENTS

| | | | |
|---|---|---|---|
| 4,377,247 | 3/1983 | Hazard et al. | 222/517 |
| 4,399,928 | 8/1983 | Klingler | 220/335 |
| 4,402,435 | 9/1983 | Libit | 222/556 |
| 4,441,637 | 4/1984 | Libit | 222/556 |
| 4,625,898 | 12/1986 | Hazard | 215/235 |
| 4,632,266 | 12/1986 | Osswald | 215/235 |
| 4,699,301 | 10/1987 | Blake | 222/546 |

*Primary Examiner*—George T. Hall
*Attorney, Agent, or Firm*—Michael G. Berkman

[57] ABSTRACT

A hinge assembly for an articulated, multi-component closure for a dispensing container. The closure includes a generally cylindrical sleeve embracing a neck of the container and secured in place. The sleeve is bridged by a transversely-extending top wall formed with a through port for dispensing the contents of the container. A cap of the closure, which is hingedly mounted on the body of the closure, carries a downwardly-projecting plug for entry into to seal the dispensing port. The hinge assembly intercouples the body of the closure or the sleeve with the lid or cap and includes cap-carried hinge shaft elements seated in cooperating slots or openings formed in the sleeve body and defining a pivot axis extending in a plane paralleling the top wall of the sleeve but displaced downwardly therefrom. The sleeve body, which may be either circular or non-circular in transverse section, is provided with cut-away wall portions for accommodating the pivoting of downwardly-extending struts which secure the cap to the hinge shaft. The closure is characterized in that no portion of the hinge assembly extends beyond the diametric limits of the closure sleeve. The structure described facilitates the use of automatic capping machinery. In one embodiment of the invention, the closure and dispensing assembly includes an adapter or reducer to reduce the diameter of the mouth of the container.

16 Claims, 4 Drawing Sheets

DISPENSING CLOSURE WITH ARTICULATED FLIP-TOP CAP

The present invention relates to closure caps for attachment to containers of the type used to dispense either solid products or liquid products.

BACKGROUND OF THE INVENTION

More particularly, the invention is directed to a multi-component closure cap operating as a flip-top device and in which a specially structured and positioned hinge assembly ensures that in the open position of a cap, the dispensing port is not only opened but is completely unobstructed visually so as to provide unimpaired monitoring of the dispensing port during delivery of product therefrom. In its more general features, the closure of the invention is of the broad type which has a top panel and an annular skirt, the latter being threadedly or otherwise secured to the neck of the dispensing container. The top or top panel is formed with a through transverse port which is the outlet or orifice from which the contents of the container are dispensed. In one embodiment of the invention the top or top panel is integrally formed with the depending skirt to constitute a unitary component of the closure assembly. A second physical element of the closure consists of a cover, cap or lid which carries on its undersurface, as a projection therefrom, a plug for entry into to seal the dispensing port in the top wall of the skirt and wall unit. Again, tops or caps of generally similar overall structure and function are known in the art.

In general, the prior art top or cap which overlies to seal the dispensing port is hingedly secured to the closure itself at an upper peripheral edge by means of a live hinge or thinned web. In other prior art structures the hinge which secures the cap or cover constitutes a combination of a live hinge web in conjunction with augmenting, cooperating connecting arms which bridge between the principal closure component and the pivotally mounted closure cap, the arrangement being described in the prior art as imparting a "snap action" to the hinge assembly.

The shortcomings of thinned web hinges or "live" hinges have been conceded in the prior art, and structures have been devised for overcoming the elasticity of such hinges which tend prematurely to return the lid of the closure to a closed position when it has been opened. One approach toward resolving this deficiency in integrally formed hinges is to provide the lid with a leg or strut having a length such that the end of the leg engages and bears upon the lid itself during the hinge operation so as to impart a toggle-like action to the closure cap as the leg acts to stretch the hinge web.

Although it has long been recognized that it would be desirable and advantageous to provide a closure having a hinged cap or lid which would be pivotal so as fully to expose the pouring or discharge orifice of the container and which would, at the same time, assume and hold the particular functional position impressed upon the lid, no completely satisfactory structure has heretofore been devised. The closures utilizing lids secured and manipulated through thinned webs or "live" hinges have either failed to maintain a positive retracted position of the lid in its "open" position, or have incorporated auxiliary structures which have in themselves been deleterious to the life of the web hinge. Many of the prior art structures have supported the pivotal cover or lid in a manner which has interfered with the visual perception and monitoring of the discharge port or orifice during the dispensing of product from the container itself. In other prior art closures the lid or cover includes a hinge portion of which extends beyond the diameter limits of the cap itself, interfering with the operation of automatic capping machinery.

It is, accordingly, a principal aim of the present invention to cure the shortcomings of prior art structures and to provide, in a container closure assembly, an improved hinge support for the overlying cap or lid, the structure being effective to ensure simple and reliable operation and to present the lid, in its open position, in a configurational mode in which there is no impairment or impediment to the viewing of the dispensing orifice even upon extreme tilting of the container as may normally occur during the dispensing of products from the container storage chamber, and in which there is no impediment to the use of automatic capping equipment.

SUMMARY OF THE INVENTION

The present invention provides, for use with a container for the storage and dispensing of solid and liquid products, multi-component flip-top closures which include an articulated hinge assembly which are simple in operation and which function so as to provide a clear and unobstructed view of a dispensing orifice in the closure of the container when the hinged, pivotally shiftable top or lid is moved to an "open" position of the closure mechanism.

It is a related object of the invention to provide a closure assembly which is readily useful in conjunction with bottles or containers of various types and which is conveniently attachable to a neck of a bottle-like container, both the container itself and the closure assembly being preferably formed of a plastics material such as polyethylene or polypropylene.

Yet another object of the invention is to provide a bottle closure of multi-piece construction which the separate pieces are readily and simply assembled without the use of tools or special auxiliary equipment.

A related advantageous feature of the present invention is the enhanced ease of molding the closure as a multi-piece assembly.

It is an important structural feature of one embodiment of the present invention that there is provided a hinge which includes, in combination, a yoke-carried hinge shaft, and a cooperating pair of slotted posts having jaws for slidably receiving and securing the shaft therewithin. In a preferred form of this embodiment of the invention, the shaft-carried yoke is integrally formed with the top or lid of the closure assembly while the jaw-defining posts are integrally formed with the closure body itself.

Yet another feature of the closure of the invention is that no portion of the hinge assembly extends beyond the diametric bounds of the cap body itself, this facilitating easier capping when using automatic machinery.

A related feature of the above-described embodiment of the invention is that the jaws which receive the hinge shaft therewithin define, adjacent their free ends, a restriction through which the hinge shaft is forceably introduced to seat in a bearing-like recess at the base of the jaw-defining posts.

The closure assembly of the invention includes, in one embodiment, a generally cylindrical sleeve or skirt which is threaded internally for attachment to a threaded neck which surmounts the container to which the closure assembly is to be attached. The sleeve or skirt is bridged or surmounted by a top wall of the closure, the latter being formed with a through port or opening serving as a discharge or dispensing orifice for delivery of product from the interior cavity of the container.

In another embodiment of the invention the sleeve is non-circular in transverse cross sections and is secured on the body of the container by means of intercoupling bead and groove elements.

In one embodiment of the invention an adapter or reducer interposed between the container-mounted sleeve and the cap to provide a product discharge port of a reduced diameter.

It is a related feature of the closure of the invention that the pivotally hinged lid or cap is integrally formed on its undersurface to extend downwardly therefrom with a plug or boss for sealing telescoping penetration into the dispensing port to seal the port during periods of nondelivery of stored contents from the container. The structure described provides the benefits of a self-cleaning, product-releasing orifice.

It is an important feature of the closure assembly of the invention that the hinge shaft upon which the lid or cap of the closure pivots is displaced downwardly of a wall which overlies the sleeve of the closure, thereby to establish a pivot axis of the cap in a locus below the wall which surmounts the sleeve.

A related feature of the invention is that a circumscribing generally cylindrical wall of the body of the closure is formed with a pair of laterally-spaced, vertically-extending through slits opening upwardly for slidable entry therewithin of the downwardly extending arms of the hinge-shaft-carrying elements, thereby permitting an annular rotational displacement of the closure lid through a full arcuate quadrant upon pivotally shifting the cap to a dispensing, port-exposing orientational mode.

In one preferred embodiment of the invention, there is provided an annular sealing ring fastened to extend from an underside of the top wall of the sleeve of the closure and stressingly engaging the neck of the container to prevent leakage of the contents of the container from the container interior when the closure assembly is in a closed mode.

Yet another feature of the invention is that the cap is formed with a downwardly projecting, circumscribing bounding locking rim for engaging the body of the closure at an upper extremity thereof to secure the cap in place on the assembly.

It is a related feature of the invention that in a preferred embodiment the locking rim is integrally formed with a radially inwardly directed annular bead which seats in a cooperating circumscribing groove formed in the body of the closure adjacent an upper end thereof.

It is an important feature of the closure of the invention that there is provided mechanical means for establishing interfering mechanical engagement between the pivotal cap of the closure and the body of the closure, operative during pivotal displacement of the cap, thereby to prevent totally free and uncontrolled and unconstrained pivotal movement of the cap between closed and opened configurations of the closure and, concurrently, to retain the cap in an open mode during the dispensing of contents from the container. In the specific embodiments of the invention illustrated, the mechanical interference is between an interior upstanding wall of the sleeve of the closure cap and lower projecting edges of the hinge-shaft-carrying arms of the hinge assembly.

In one preferred embodiment of the invention the closure assembly includes, in addition to the threaded tubular sleeve, a coaxial, generally cylindrical wall displaced radially outwardly of the sleeve and having a diameter at its base or lower limit corresponding with a diameter of a container body at an upper edge of the body presented to the closure wall so as to provide an essentially uninterrupted outer wall of the container and its surmounting closure.

In that embodiment of the invention in which the container body is non-circular in transverse cross section, a preferred configuration is an oval cross section.

Other and further objects, features and advantages of the invention will become apparent from the following detailed description considered in conjunction with the drawings.

BRIEF DESCRIPTION OF THE DRAWIGNS

DETAILED DESCRIPTION OF PREFERRED EMBODIMENTS

Figure 1:
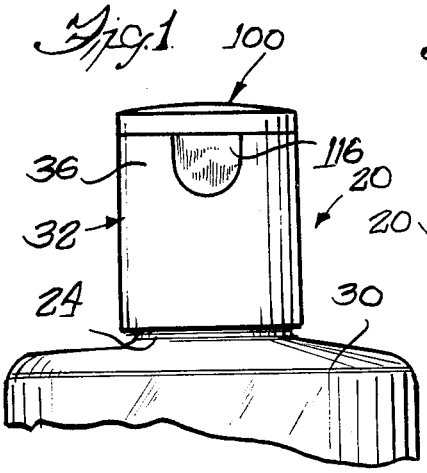
FIG. 1 is a front elevational view showing the closure of the invention affixed to a container body, and with the hinged closure cap in a closed position.
Figure 2:
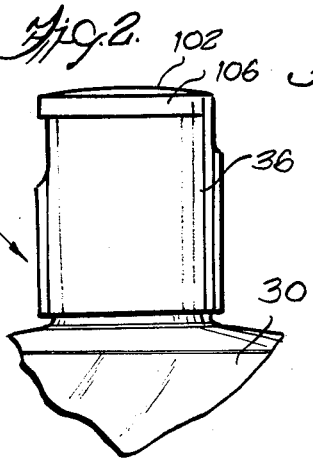
FIG. 2 is a side elevational view of the closure of FIG. 1.
Figure 3:
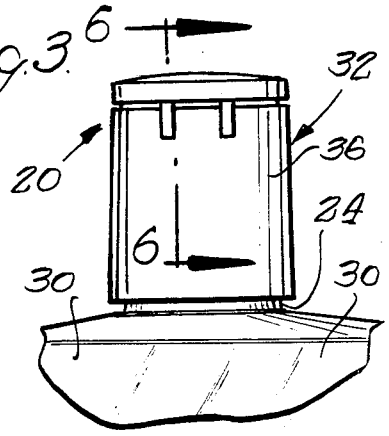
FIG. 3 is a rear elevational view of the closure of FIG. 1.
Figure 4:
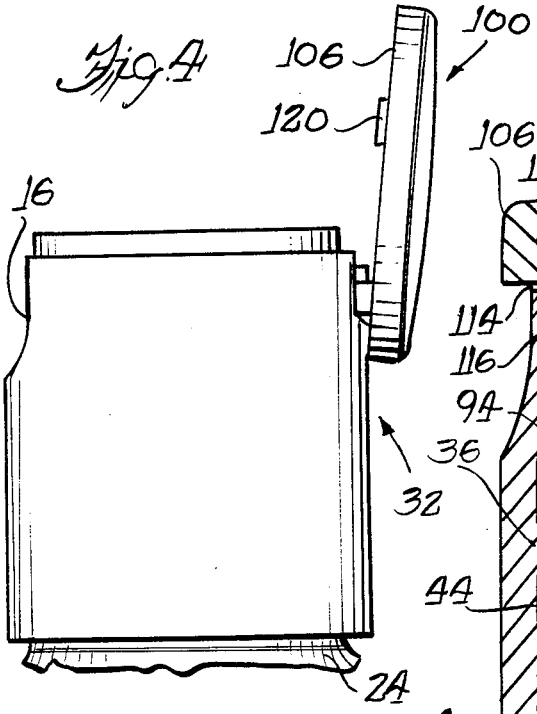
FIG. 4 is a side elevational view of the closure of the invention, with the hinged cap in a fully opened position.
Figure 6:
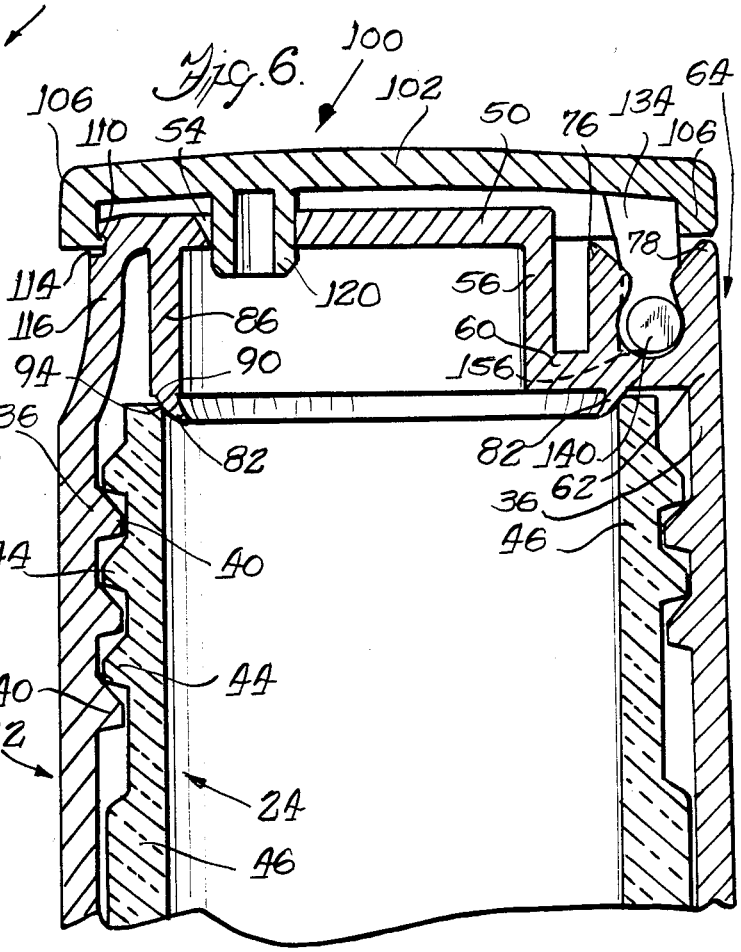
FIG. 6 is an enlarged, vertical cross-sectional view taken substantially on the lines 6—6 of FIG. 3 and showing the mode of securement of the cap to the closure body, in accordance with one embodiment of the invention.
Figure 5:
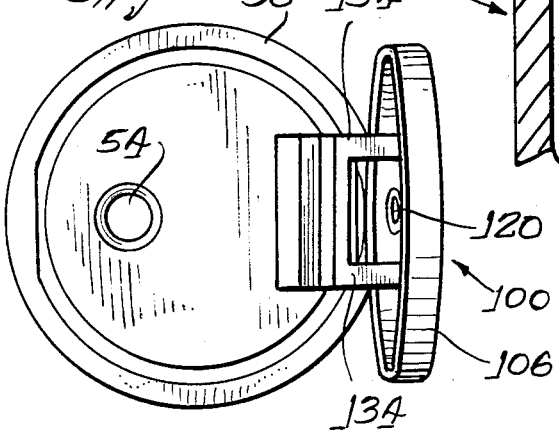
FIG. 5 is a top plan view of the structure depicted in FIG. 4, and showing the cap hingedly attached to the closure body.

The aims and objects of the present invention are achieved by providing a container closure of multi-component construction and securable to the neck of a container for dispensing solid and liquid products. The closures define a base which includes a sleeve which embraces and grippingly engages the neck of the container. The sleeve itself is surmounted by a bridging top wall formed with a through port for dispensing the contents of the container, and the closure assembly is completed by a hinge-mounted top or lid pivotally supported on the body of the closure. The lid carries, on its underside and projecting therefrom, a plug or boss which telescopically penetrates and seals within the dispensing port of the closure body.

The cap or lid of the closure is pivotally coupled to the body through a hing assembly in which a cap-carried hinge shaft element seat in cooperating slots, openings or depressions formed in the body of the closure. In one form of the invention there are provided slots defining a restricted opening through which a hinge shaft is forcibly urged to seat in a bearing recess at a base of the arms forming the slot. It is an important feature of the invention that the pivotal axis defined by the hinge shaft extends in a plane which parallels the top wall of the sleeve but which is displaced downwardly therefrom. An outer, circumscribing wall of the closure body is formed with a pair of laterally-spaced, vertically-extending through slits opening upwardly for slidable entry of the arms, extending downwardly from an underside of the cap of the closure and which carry the hinge shaft or hinge shaft elements. The arrangement described facilitates rotational displacement of the cap through a full arcuate quadrant upon pivotally shifting the cap to a dispensing port exposing orientational mode.

In order to hold the hinged cap in an open orientation, the structure of the closure, as described herebelow, provides an interfering mechanical engagement between the closure cap and the closure body so as effectively and selectively to latch the cap in an open position, thereby insuring unimpaired visibility of the dispensing port and monitoring capability during the product dispensing operation.

For convenience of description, the closure of the present invention is described below for use in conjunction with as a structure secured to a container. The container itself does not, per se, constitute an inventive element of the invention, and accordingly, is not described in detail herein.

Referring now to the drawings, and more particularly to FIGS. 1–6, there is shown one preferred embodiment of the closure of the invention provided for illustrative purposes and not to be construed in any limiting sense. The closure 20 is shown as fastened on the neck 24 of a container 30. The closure 20 depicted in FIGS. 1–6 includes a sleeve 32 defining an outer generally cylindrical wall or skirt 36 formed on its interior surface with threads 40 for intercoupling mating engagement with cooperating threads 44 of the neck 24 of the container 30. Surmounting the sleeve-like wall 36 of the closure 20 is an integrally formed top wall 50 provided with a through port or orifice 54 through which the material stored in the container 30 is dispensed.

Figure 7:
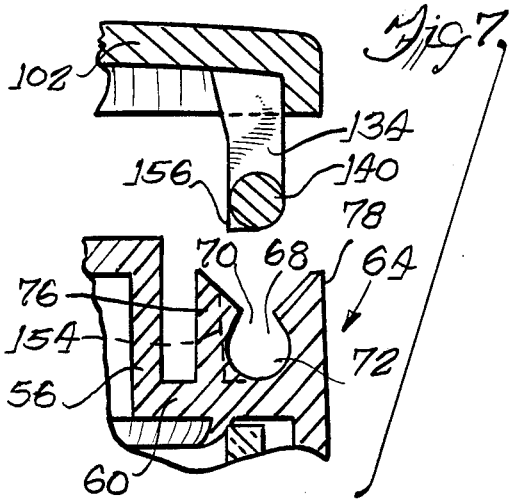
FIG. 7 is an enlarged, fragmentary, exploded vertical cross-sectional view showing the intercoupling cooperating snap-in hinge components for pivotally securing the cap to the container-mounted closure body.

At its end rearward of the dispensing port 54 the top wall 50 is connected to a downwardly projecting vertical wall 56 terminating in a rearwardly projecting horizontal plate 60 which, in the (FIGS. 7–9) embodiment of the invention depicted, abuts and is integral with the outer wall 36 of the closure at a rear zone 62 of the assembly. Integrally formed with the plate 60 and projecting upwardly therefrom are a pair of laterally-spaced posts 64 each being formed with upwardly opening slots 68 contoured to define a constricted entry 70 and an enlarged bearing-defining recess 72 at the base. The opposed, facing jaws 76 and 78 have some resiliency, which feature facilitates the assembly of the two-piece closure, the bifurcated posts 64 serving as a lower hinge component, as is more fully described hereinafter.

Referring further to the sleeve-like cylinder 32 and its surmounting wall 50, the structure is further provided with an annular sealing ring 82 displaced downwardly of the top wall 50 as a terminus of an annular web 86 integrally formed with and projecting generally normally of the top wall 50. In a zone adjacent the rear of the closure assembly, the sealing ring 82 is integrally formed with and defines a downwardly directed projection from the plate 60. As indicated schematically in FIG. 6, an outer bounding edge surface 90 of the sealing ring 82 abuts and bears upon a facing abutting interior, upwardly presented annular edge 94 of the wall 46 of the neck 24 of the container 30 to provide a positive, resilient seal at the mouth of the container.

The closure assembly 20 includes, as a second distinct component, a lid or cap 100, which in the specific embodiments of the invention illustrated defines a generally planar but slightly vaulted top wall 102 with a circumscribing downwardly directed bounding rim 106. In the embodiment of the invention shown in FIG. 6, the rim 106 is integrally formed with a radially inwardly directed annular bead 110 which lockingly invades and seats within a cooperating annular groove 114 formed in an upper sector 116 of the sleeve wall 36. As clearly shown in FIG. 6, the upper sector 116 of the wall 36 of the sleeve 32 is displaced radially inwardly so that the rim 106 of the top 100 extends outwardly for ready and convenient digital access insuring that the closure assembly may be conveniently opened without undue effort.

Figure 9:
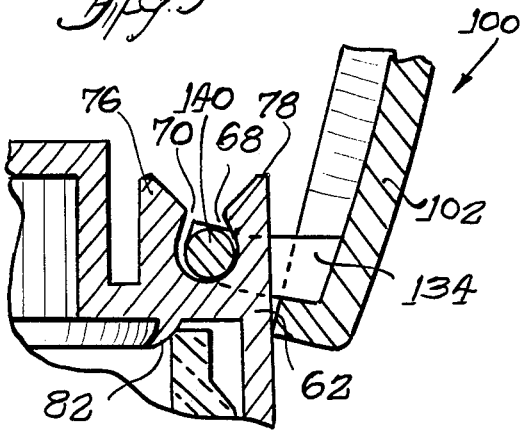
FIG. 9 is a view similar to that shown in FIG. 8, but with the hinged cap in a fully opened position.
Figure 10:
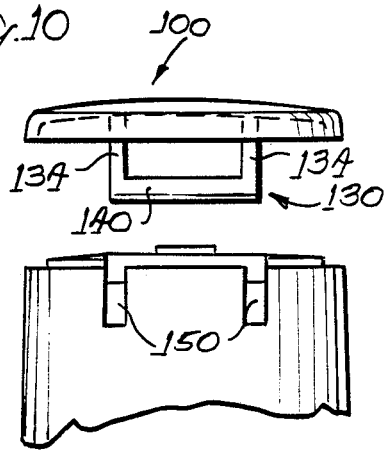
FIG. 10 is an exploded, rear elevational view of the closure body and the closure cap, according to the invention, and showing the yoke-mounted, cap-carried hinge shaft.
Figure 11:
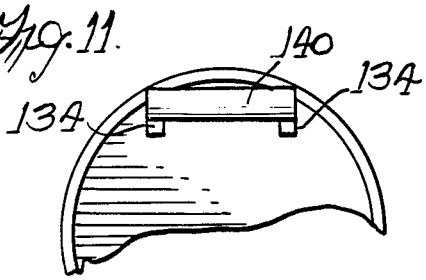
FIG. 11 is a fragmentary top plan view of the underside of the cap of the closure of the invention, showing the integrally formed hinged shaft fastened thereto.
Figure 12:
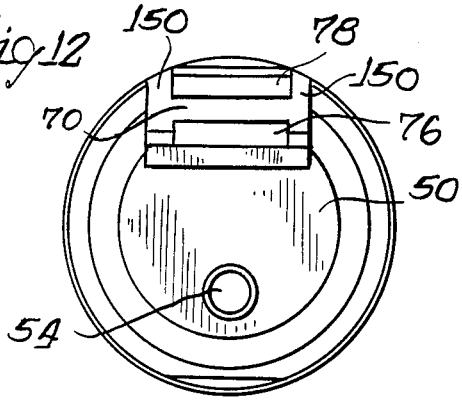
FIG. 12 is a top plan view of the closure body with the cap removed.

The top wall 102 of the cap 100 of the closure 20 is integrally formed with a generally cylindrical plug 120 projecting downwardly from an underside of the cover 102 and located for registry with for sealing, telescoping penetration into the dispensing port 54 to seal the port during periods of nondelivery of stored contents from the contents. Referring further to the structure of the cap 100, the latter is provided at a zone adjacent and overlying the posts 64 of the sleeve unit 32, for functional cooperation with the posts 64, with a yoke assembly 130 which includes a pair of laterally spaced arms 134 fastened to and extending generally downwardly from an undersurface of the top wall 102 of the cover 100 and terminating in a generally horizontally extending hinge shaft 140, the latter being positioned and so sized as to permit forcible insertion thereof through the constricted opening 70 between the jaws 76 and 78 to seat in the recess 72 of the hinge assembly, the arms 134 of the yoke 130 being disposed laterally outwardly of the jaws 76 and 78. (FIGS. 9 and 10).

It will be noted that the pivotal axis of the hinge assembly of the invention, as illustrated and described, is substantially below a plane defined by the top wall 50 of the sleeve 32 of the closure 20. In order to permit a full quadrant of rotating pivotal displacement of the cover 100, and more particularly to obviate any mechanical impediment as the cover 100 is hingedly opened, the rear wall 62 of the sleeve 32 is formed with a pair of vertically-extending through slits 150 sized and spaced for lateral correspondence with the arms 134 of the yoke 130 so that upon pivotally shifting the cap 100 to an open position in exposing the dispensing port 54, the arms 134 of the yoke 130 of the top 100 are received in and move downwardly through the slits 150, permitting a full arcuate retraction of the lid 100 from the top wall 50 of the sleeve 32, as depicted in FIG. 9. The arrangement described insures a completely unimpaired view of the product discharge port 54 during the dispensing of the contents of the container 30.

Figure 8:
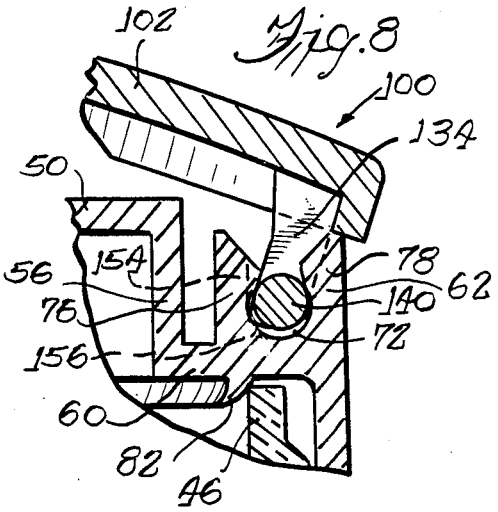
FIG. 8 is an enlarged, fragmentary, vertical cross-sectional view showing the cap hingedly secured in place on the closure body, in a partially opened position.

Referring further to the structure of the hinge assembly, and more particularly to FIG. 8, the physical arrangement and dimensioning of the component elements of the hinge assembly are such that in pivoting the cap 100 about the hinge shaft 140 there is established an interfering mechanical engagement between an interior, vertical wall 154 of the sleeve 32 opposite the hinge shaft 140 and the shaft-supporting yoke arms 134 and edge-like projections 156 formed at a lower extremity of the yoke arms 134. In the structure described the projections 156 are directed toward and abut and stressingly bear against the wall 154 as the lid 100 is hingedly pivoted on the shaft 140 between closed and open positions of the closure 20. Thus, there is provided a "toggle" effect as the cap 100 is pivoted between a fully closed to a fully opened position. The physical structure described establishes a detent which prevents the cap from swinging to a closed position or to a position in which viewing of the dispensing port 54 is impaired when the container is tilted to deliver product from the container itself.

Figure 13:
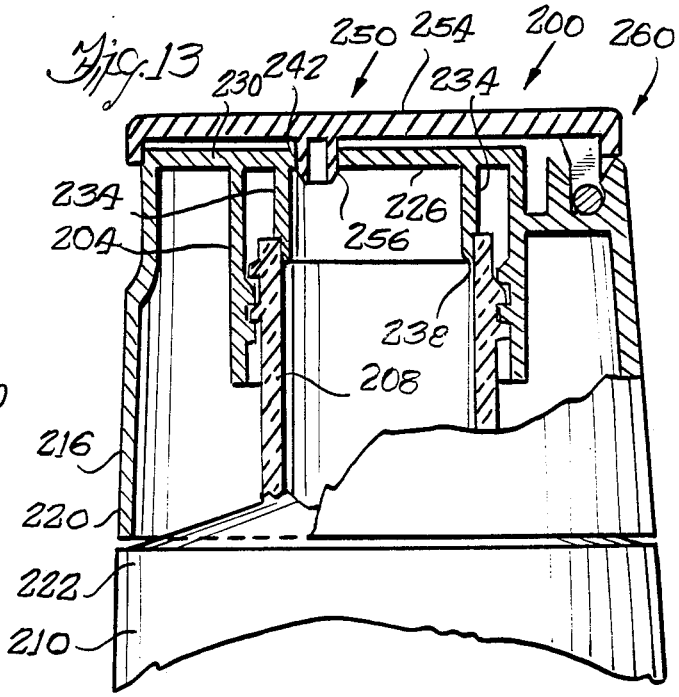
FIG. 13 is an enlarged, vertical cross-sectional view of a second embodiment of the closure of the invention fixed in place on a container and with the hinged cap in a closed position.

A somewhat modified closure assembly 200 is illustrated in FIG. 13. As there depicted, the closure includes, in addition to a threaded sleeve 204 for threaded engagement with the threaded neck 208 of the container 210, an outer, secondary wall 216 defining a generally cylindrical wall coaxial with the wall 204 and displaced radially outwardly thereof. The wall 216, which is angled slightly upwardly and inwardly, has an outer diameter at its lower edge 220 which is essentially the same as the outer diameter of the container at its upper shoulder 222 so that the closure wall 216 continues the line of the container in an essentially uninterrupted aesthetic mode. Connected to and extending downwardly from an underside 226 of a top wall 230 surmounting the walls 216 and 204 of the closure is a depending skirt 234 a lower peripheral edge portion 238 of which enters within to interengage with the neck wall 208 of the container 210 to establish a frictional, fluid-tight seal obviating spillage of the contents of the container. As in the first embodiment of the closure described, the top wall 230 is formed with a dispensing port 242, and the lid 250 of the closure 200 is formed on the underside of the top wall 254 to extend downwardly therefrom with a plug 256 dimensioned for telescoping entry into the port 242 to seal the port when the lid is in a closed position. Completing the structure, the second embodiment of the closure is provided with a hinge assembly 260 which in all material respects corresponds to the structure previously described with reference to the first embodiment.

Another embodiment of a closure assembly according to the invention and adapted for use with a non-circular and preferably generally oval container, is shown in FIGS. 14 through 23. The product storage and dispensing device 300 is shown as including a container 302 having a body or product-storage reservoir 304 of a generally oval cross-sectional configuration and including a floor 306, and opposed arcuately convex front and rear walls 308 and 310 connected to one another by a pair of narrow, coextensive side walls 314 and 316. As clearly shown in FIG. 20, the container body 304 is surmounted in sequence, by a frusto-elliptical section 320, a pair of radially inwardly stepped sections 324 and 326 and an open-top annular neck 330. The latter circumscribes a mouth opening 334 in communication with the interior of the container 302. The annular section 332 constitutes a lip-like wall which is cylindrical on its exterior 336 and is formed interiorly with an outwardly and upwardly flared surface 340.

Mounted on the neck 330 of the container 302 is an adapter or reducer 348 (FIGS. 19 and 20) for effectively reducing the diameter of the neck opening 334 of the container 302. In the illustrative embodiment of the reducer 348 the latter is of a firm but resilient plastics material and is structured to snap-lock onto and over the annular wall 332 bounding the mouth at the container neck 330. A pair of radially spaced inner and outer walls 352 and 354 extending downwardly from a surmounting horizontal wall-like web 358 define therebetween a downwardly open annular moat-like trough 360 in which the lip 332 of the container 302 seats in contiguously nesting, mating engagement. Adjacent its lower end the outer annular wall 354 of the reducer 348 is integrally formed with a coextensive, radially inwardly directed annular rib 364 which functions as a retainer to hold the adapter in place on the lip-like wall 332 at the neck 330 of the container 302.

Connected to the top wall 358 of the adapter 348 at a position displaced radially inwardly of the inner lower wall 352 is an upwardly projecting annular neck-like web 368 defining an opening or dispensing port 370 of a diameter radially reduced as compared to the open mouth 334 of the container 302 itself.

Figure 18:
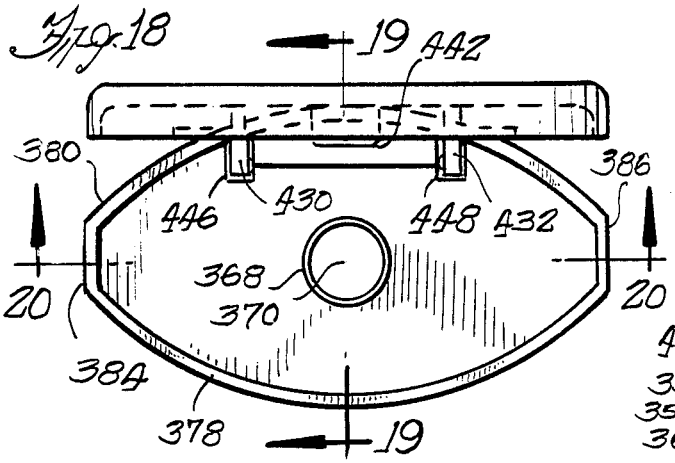
FIG. 18 is a top plan view of the container of FIG. 17, with the lid in an open mode.
Figure 19:
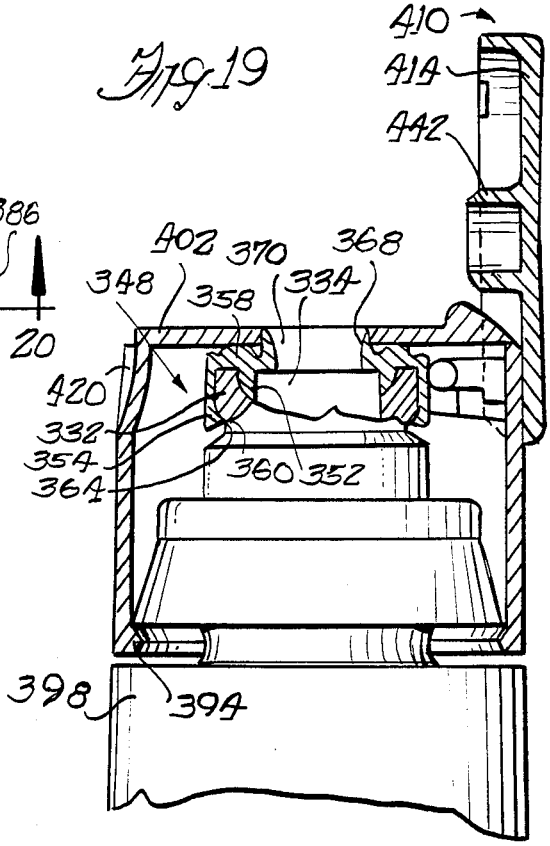
FIG. 19 is a cross-sectional view taken substantially on the lines 19—19 of FIG. 18 and showing the snap-on reducer in place on the container neck and the overcap secured in a groove circumscribing the container.
Figure 20:
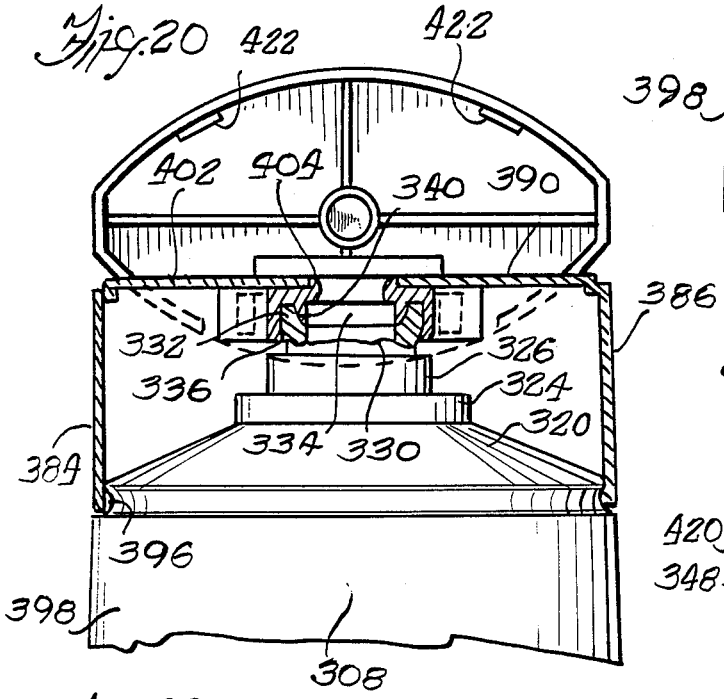
FIG. 20 is a cross-sectional view taken substantially on the lines 20—20 of FIG. 18 and showing the reducer and the overcap in section.
Figure 16:
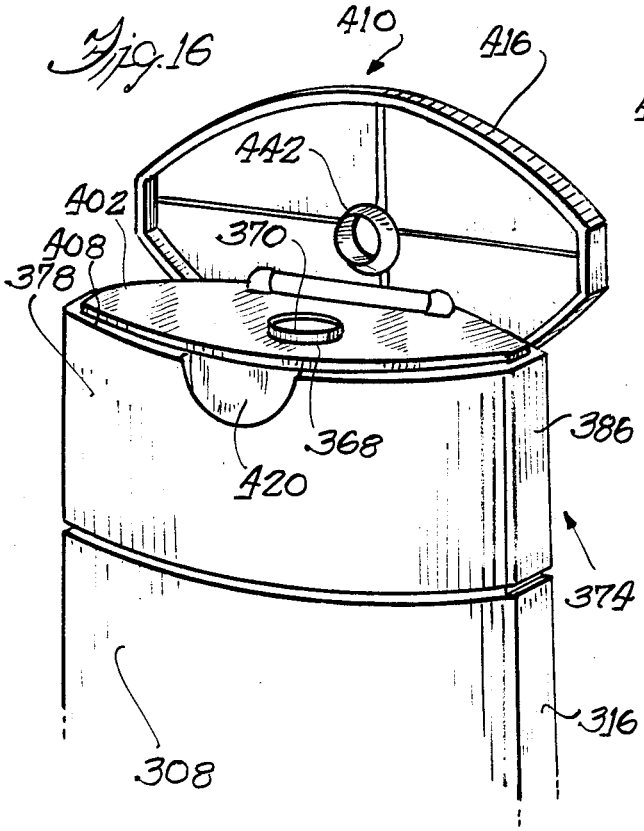
FIG. 16 is an enlarged, fragmentary, prespective view of the container of FIG. 14, with the cap of the closure in a hingedly open position.
Figure 17:
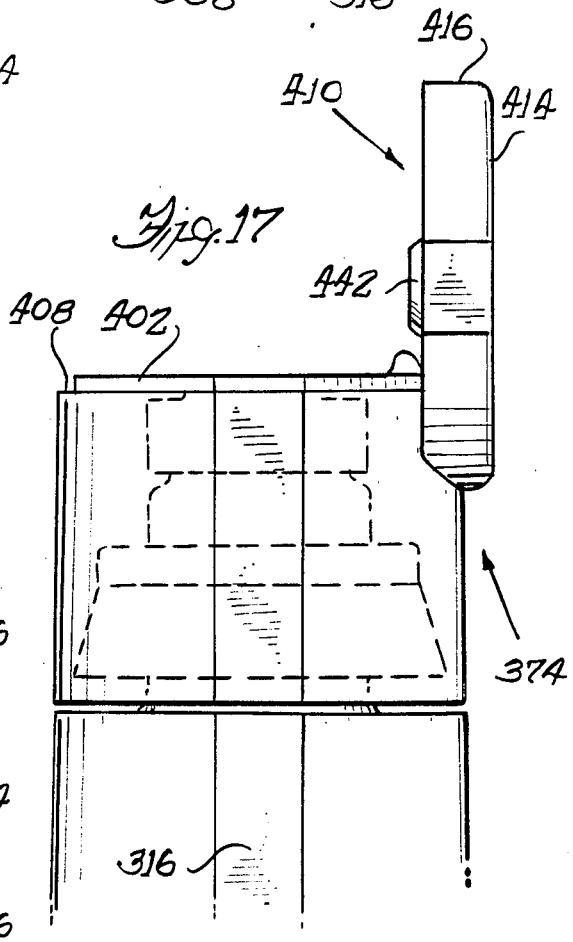
FIG. 17 is a fragmentary, side elevational view of the container and closure of FIG. 16 with the cap open, and indicating, in phantom, the neck of the container and a surmounting orifice-reducing adapter.

The structure by means of which the product discharge port 370 is sealed to confine the contents of the reservoir 304 during periods of non-use of the dispensing container 302 is shown in FIGS. 16 through 23. A sleeve-like overcap 374 has front and rear walls 378 and 380, side walls 384 and 386 congruous with and constituting in-line extension of corresponding walls of the container body 304 of the overcap or sleeve 374. The overcap 374 is held in place by an annular bead 394 which seats in a groove 396 at the top 398 of the body or reservoir portion 304 of the container 302 as shown in FIG. 19. A top wall 402 is formed with a circular cutout 404 which is in coaxial registry with the upstanding web 368 of the adapter 348 and into which the web 368 projects, as shown in FIGS. 16 and 19. The top wall 402 is set back about its periphery to provide a shoulder-like ledge 408 upon which a cover or lid 410 of the container 302 seats.

The cover 410, shaped and dimensioned to have the same perimetric configuration as the container body 302, has a top wall 414 and a circumscribing depending skirt 416 which sleeves over the top wall 402 of the overcap 374, with the lower edge of the skirt 416 seating on the shoulder 408. The front wall 378 of the overcap 374 is formed with a radially inwardly depressed finger access recess 420 to facilitate one's elevating the lid 410 to an upper mode. The lid 410 is formed interiorly of the skirt 416 with tabs 422 to retain the cover frictionally secured when closed.

Attached to and extending downwardly from an underside 426 of the lid 410 of the closure assembly at a rearward zone of the cap 410 are a pair of laterally spaced hinge arms 430 and 432 formed on facing inner lateral sides thereof with horizontally projecting protuberances, bosses or knobs which function as stub-like hinge shafts 436, 438. Integrally formed with and also projecting downwardly from the underside 426 of the cap 410 is a plug 442 for sealingly penetrating the product dispensing port 370 of the adapter 348 when the lid 410 is in a closed position.

The top wall 402 of the sleeve 374 is formed at a rear marginal zone thereof with a pair of laterally-spaced slots 446 and 448 into which the hinge arms 430 and 432 are received (FIG. 18). Walls 452 fastened to and depending from the top wall 402 of the overcap sleeve 374 parallel the arms 430 and 432 and are spaced to extend adjacent to for cooperation with the hinge arms 430 and 432, the walls 452 being formed with socket-like recesses or openings 460 into which the diminutive hinge shafts 436 and 438 are hingedly received.

The overcap 374 is also formed with spaced, upwardly opening slits in a rear wall 380 thereof and in line with and communicating with the slots 446, 448 in the top wall 402. The structure described enables one pivotally to swing the cap 410 upwardly through a full quadrant so as to expose the top 402 of the overcap sleeve 374 and the product discharge port 370 to view, thereby to enhance the ease of controlling and metering the quantity of product from the storage reservoir.

Figure 21:
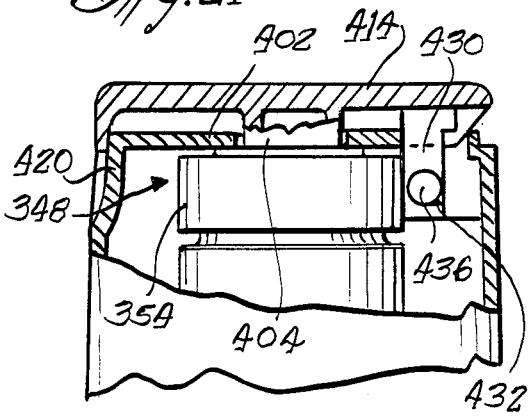
FIG. 21 is a side elevational view, partly in section, and showing the dispenser cap assembly in a closed disposition.
Figure 22:
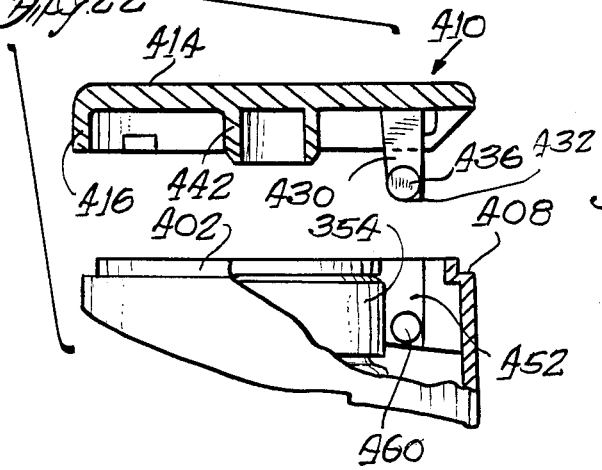
FIG. 22 is an exploded view of the assembly of FIG. 21.
Figure 23:
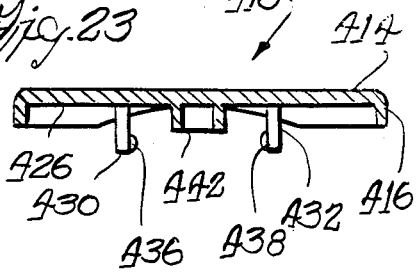
FIG. 23 is a cross-sectional view of the over-cap of the closure assembly of the invention and showing the downwardly projecting hinge legs.
Figure 14:
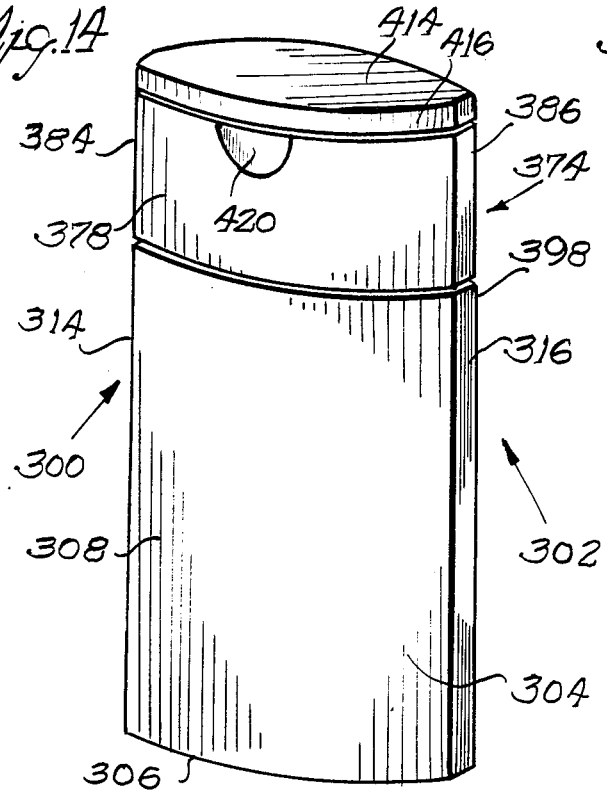
FIG. 14 is a perspective view of an oval container having a closure embodying the principles of the present invention, this embodiment utilizing a three-piece dispenser assembly including an orifice-reducing adapter, a snap-on sleeve or overcap, and a pivotal cap or lid.
Figure 15:
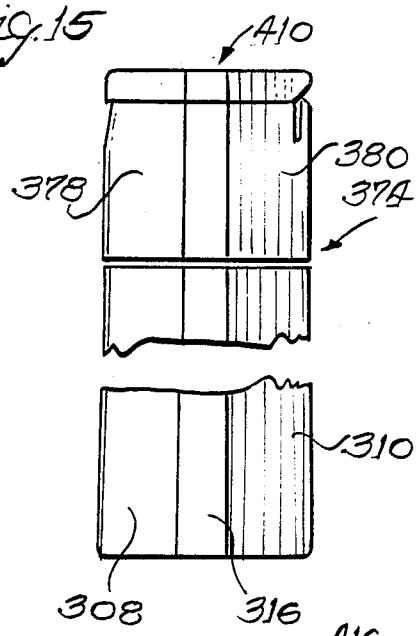
FIG. 15 is a side elevational view of the container of FIG. 14, on a somewhat reduced scale.

As indicated in FIG. 21, each hinge arm 430 is formed at a lower end edge with a projection 432 which abuts and stressingly bears upon an adjacent laterally extending wall section as the cap 410 hingedly pivots on the stub shafts 436 and 438 between open and closed positions. This results in a toggle-like effect to stabilize the cap in selected positions, all in a manner as previously described with reference to the embodiment of the invention illustrated in FIG. 8.

It is an important feature of the closure of the present invention that it provides an improved hinging mechanism by means of which the lid is readily pivotal to a fully retracted position with respect to the container top. The interference established between the lid and the body of the closure ensures that the lid will remain in an open configuration even during the tilting of the container in dispensing product. The structure described also ensures positive sealing closure of the dispensing orifice and a stabilized registry of articulated components.

What is claimed is:

1. In a container for storage and for the dispensing of products, said container including a floor and a circumambient upstanding wall defining a storage chamber, a generally cylindrical open-top neck integrally formed with and extending upwardly of said walls of said chamber, a multi-component closure embracing and surmounting said neck, said closure comprising a body including a sleeve formed with means for intercoupling mating engagement with said container adjacent said neck for attaching said closure to said container, a top wall bridging said sleeve of said closure, said top wall being integral with said sleeve and being formed with a product-dispensing port extending transversely therethrough and in fluid flow communication with said chamber for dispensing container-stored contents therefrom, said closure including a pivotally-manipulable cap for sealing said port, a plug carried by and projecting from an underside of said cap, said plug being hingedly shiftable with said cap and selectively positionable for telescoping sealing penetration into said dispensing port to seal said port during periods of non-delivery of stored contents from said container, hinge means for pivotally supporting said cap on said closure body for facilitating shifting of said cap between a closed position of said container in which said cap overlies and generally parallels said top wall of said sleeve to present said cap-carried plug into said product-dispensing port in sealing engagement therewith, and an open position in which said cap is pivotally shifted to withdraw said plug from said port to unblock said port and to permit dispensing of container-stored contents therefrom, the improvement comprising, mounting means for supporting said cap on said closure body for pivotal displacement through an arcuate quadrant to assume in a product-dispensing mode of said container a stabilized configuration in which said top wall of said sleeve is essentially fully uncovered to permit unimpaired visual monitoring of said dispensing port during delivery of product therefrom, said mounting means comprising a hinge assembly intercoupling said cap and said body of said closure, said hinge assembly including wall means extending normally of and depending from said top wall of said sleeve for bounding a hinge-arm-receiving opening, slot means formed in said closure body at laterally spaced positions adjacent a marginal zone of said body and defining an upwardly opening cavity for receiving hinge arms therewithin during pivotal displacement of said cap to a port-exposing open position of said container, cap-carried hinge arm means for cooperative entry into said slot means, said arm means extending downwardly from said cap at rearward peripheral portion of said cap to project from an underside of said top wall thereof, said arm means being positionally oriented for spatial registry with said slot means for permitting pivotal penetration of said hinge arm means into said slot means, hinge shaft means for mechanically intercoupling said hinge arm means of said cap with said wall means of said sleeve and for pivotally and hingedly supporting said cap on said sleeve body during manipulative shifting of said cap between a closed configurational, sealing mode and a product-dispensing, open mode of said closure.

2. The improvement as set forth in claim 1 wherein said hinge assembly includes a closure-body-carried pair of laterally-spaced posts, each of said posts having opposed jaws defining upwardly opening slots having a constricted entry for forced insertion of a cap-carried hinge shaft through said slots between said jaws to seat in bearing-defining recesses at bases of said slots, a yoke attached to and depending from said cap, said yoke including a pair of arms joined to and projecting downwardly from an underside of said cap, a hinge shaft for pivotally supporting said cap, and attached to and extending between arms of said pair of arms and generally normally thereof, said hinge shaft being forcibly insertable through said slots between said jaws to seat in said slots and being pivotally shiftable within said recesses of said slots, and said hinge shaft being restrained by said jaws against inadvertent withdrawal from said slots.

3. The improvement as set forth in claim 2 wherein said hinge shaft extends between and interconnects said arms of said yoke at downwardly directed end portions of said arms, and wherein said slots and said hinge shaft pivotally confined therewithin are displaced downwardly of said top wall of said sleeve to establish a pivot axis of said cap at a locus below a plane defined by said top wall bridging said sleeve.

4. The improvement as set forth in claim 2 wherein said hinge shaft comprises boss means at lower end portions of said arm means and extending laterally inwardly thereof, and wherein said boss means seat within cooperating recesses formed in said wall means of said sleeve, and wherein said recesses and said hinge shaft pivotally confined therewithin are displaced downwardly of said top wall of said sleeve to establish a pivot axis of said cap at a locus below a plane defined by said top wall bridging said sleeve.

5. The improvement as set forth in claim 1 wherein said body of said closure is formed with a pair of laterally-spaced, vertically-extending through slits opening upwardly of a circumscribing, vertically-extending wall of said closure for slidable invasive entry of said arms of said cap-carried yoke into said slits, thereby to facilitate pivotal displacement of said arms and of said cap carried thereby through a full, arcuate, vertical quadrant upon pivotally elevating said cap to a port-exposing, product-dispensing orientational mode.

6. The improvement as set forth in claim 1 and further comprising threads formed externally on said neck of said container, and cooperating threads formed internally on said sleeve of said closure, annular sealing ring means for sealing between said closure and said container, said sealing ring means circumscribing and projecting downwardly of and from said top wall of said sleeve and stressingly abutting and bearing against said neck of said container interiorly of said neck at an upper open end thereof when said sleeve is threadedly advanced on and secured to said neck of said container.

7. The improvement as set forth in claim 1 and further comprising an annular locking rim extending downwardly of and circumscribing a bounding edge of said cap for engaging said body of said closure at an upper extremity thereof to secure said cap to overlie said sleeve in firm engagement therewith.

8. The improvement as set forth in claim 7 and further comprising an annular bead integrally formed with and projecting radially inwardly of said rim coextensively therewith, and wherein said body of said closure cap is formed with a groove adjacent an upper end thereof for receiving said bead therewithin to lock said cap in a container-sealing mode.

9. The improvement as set forth in claim 1 and further comprising detent means for restraining said cap in an open position and for preventing totally free and unrestrained pivotal movement of said cap between open and closed configurations of said closure.

10. The improvement as set forth in claim 2 and further comprising detent means for restraining said cap in an open position and for preventing totally free and unrestrained pivotal movement of said cap between open and closed configuration of said closure.

11. The improvement as set forth in claim 9 wherein said said detent means comprises wall means depending from a top wall of said sleeve and coextensive with and opposing said yoke and said arms thereof, and edge means formed on said arm of said yoke, said wall means having a generally vertical surface facing toward said arms of said yoke of said hinge assembly, said edge means being opposed to said wall means and projecting downwardly and outwardly from said arms at bases thereof, said edge means being presented toward for abutting and for stressingly bearing against said wall means during pivotal movement of said lid about said hinge shaft means, and said wall means and said edge means establishing a mechanical interference for restraining and for maintaining said cap in an open position during dispensing of product from said container.

12. The improvement as set forth in claim 1 wherein said hinge assembly intercoupling said cap and said body of said closure is confined totally within diametric bounds of said sleeve of said closure body, for facilitating employment of automatic capping machinery.

13. The structure as set forth in claim 1 wherein said means for intercoupling mating engagement between said sleeve of said closure body and said container comprises, in combination, cooperating groove means and bead means on the components to be intercoupled.

14. The structure as set forth in claim 1 wherein said container is generally oval in transverse cross section.

15. The structure as set forth in claim 1 and further comprising an adapter surmounting said neck of said container, attachment means for fastening said adapter to said neck in fluid-tight engagement therewith, said adapter including a top wall formed with an opening therethrough and aligned coaxially with and in fluid flow communication with an opening in said open-top neck of said container and with said port in said top wall of said sleeve, said opening in said adapter being of a diameter reduced as compared with the opening in said open-top neck and dimensioned for sealingly receiving therewithin said plug of said cap.

16. The structure as set forth in claim 15 and further comprising an annular collar integral with and extending upwardly of said top wall of said adapter and bounding said opening therethrough, and wherein said top wall of said sleeve overlies said adapter, with said annular collar of said adapter penetrating said top wall of said sleeve at said port of said sleeve.

* * * * *